US005105893A

United States Patent [19]

Barnak

[11] Patent Number: 5,105,893

[45] Date of Patent: Apr. 21, 1992

[54] OIL WELL FIRE DROWNING AND EXTINGUISHING CONTAINMENT APPARATUS

[76] Inventor: Daniel J. Barnak, 7536 Cliffbourne Dr., Fayetteville, N.C. 28303-2302

[21] Appl. No.: 672,936

[22] Filed: Mar. 21, 1991

[51] Int. Cl.[5] ..... A62C 3/06

[52] U.S. Cl. ..... 169/46; 169/49; 169/52; 169/69

[58] Field of Search ..... 169/69, 43, 46, 49, 169/52; 166/81, 192

[56] References Cited

U.S. PATENT DOCUMENTS

| | | | |
|---|---|---|---|
| 739,377 | 9/1903 | Bell | 169/69 X |
| 1,807,498 | 5/1931 | Teed | 169/69 X |
| 1,857,788 | 5/1932 | Murphy | 169/69 X |
| 1,859,606 | 5/1932 | Sievern et al. | 169/69 X |
| 3,463,227 | 8/1969 | Smith | 169/69 X |
| 3,664,429 | 5/1972 | Jones | 169/69 |

FOREIGN PATENT DOCUMENTS

| | | | |
|---|---|---|---|
| 83947 | 8/1971 | German Democratic Rep. | 169/69 |

*Primary Examiner*—Margaret A. Focarino
*Assistant Examiner*—Andrew C. Pike

[57] ABSTRACT

The present invention is an oil well fire extinguisher. The oil well extinguisher has a base and a wall structure which extends upwards from the base to enclose an area above the base. Integral with the base is a flange assembly having a series of flanges encircling the base and on which the oil well fire extinguisher is supported. A base opening encircled by a flange leads into a main or throttle chamber within the wall structure. The throttle chamber is encompassed by a throttle assembly which extends upward from the base at an acute angle, resulting in the area of the throttle chamber to decrease as the chamber extends upwards towards the top of the wall structure. A ceramic cap is fixed at the top of the wall structure and deflects oil and heat from the throttle chamber, through velocity diffusion bars, and into an outer collection chamber. The outer collection chamber has velocity diffusion plates having angled lips and extending therein to help with the collection of unburnt oil. In operation, the oil well extinguisher's base opening is placed over an oil well or oil collection system. Unburnt oil and energy is directed upwards through the main chamber by the throttle assembly, deflected by the ceramic cap, and directed into the collection chamber. The unburnt oil collects in the collection chamber and spills over into the main chamber to help suffocate the fire.

9 Claims, 3 Drawing Sheets

OIL WELL FIRE DROWNING AND EXTINGUISHING CONTAINMENT APPARATUS

BACKGROUND OF THE INVENTION

1. Field of the Invention

The invention is a device for position upon an oil well fire to extinguish the flame.

2. Description of the Prior Art

Oil well fires exist when a combustible matter contacts oil and gases from a deviation of the collection system. These fires consist of the high pressure type and the low pressure type. The act of fire cessation is accomplished by removal of fuel, removal of flame, removal of ambient air, or a combination of the aforementioned fire requirements. No device until now has been engineered to encompass the fire and provide extinguishing through suffocation and drowning.

SUMMARY OF THE INVENTION

The invention comprises a containment structure which is placed over an uncontrollable oil wellhead or a deviation of a collection system, having gases and oil escaping therefrom and supplying fuel for a fire. This device encloses the immediate area surrounding the fire and forms a near impervious seal around the fire. When in position, the present invention device restricts the ambient air surrounding the fire, and in addition collects unburnt oil escaping from the oil well or collection system. The fire continues to burn utilizing the existing air within the sealed device, diminishing the supply of air within the device. The unburnt oil collects in a chamber within the containment structure but is separated from the fuel source. As the unburnt oil rises in the collection chamber, it overflows into the main or throttle chamber encompassing the fuel source. Thus, the device seals and contains the air flow within the device, and also provides a drowning effect upon the fire itself.

DESCRIPTION OF THE PREFERRED EMBODIMENT

Figure 1:
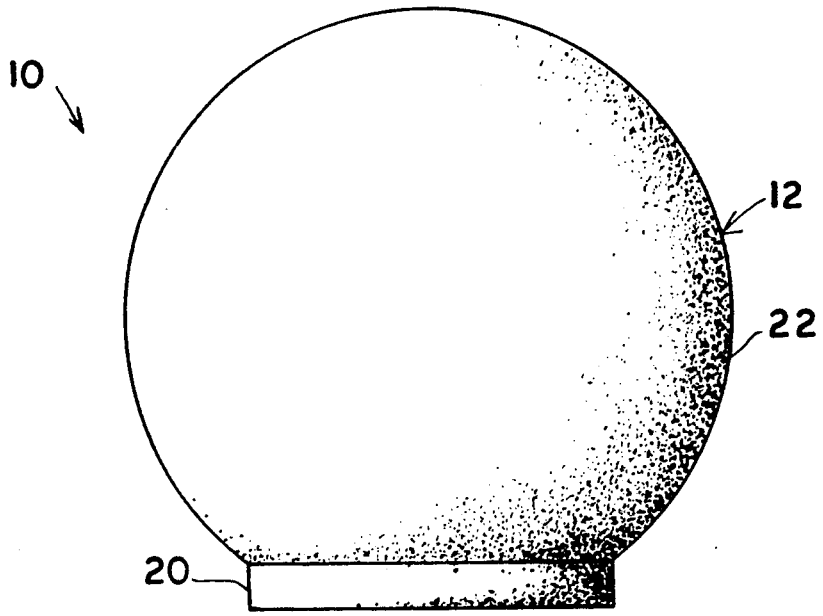
FIG. 1 is a side view of the Oil Well Fire Extinguisher.
Figure 2:
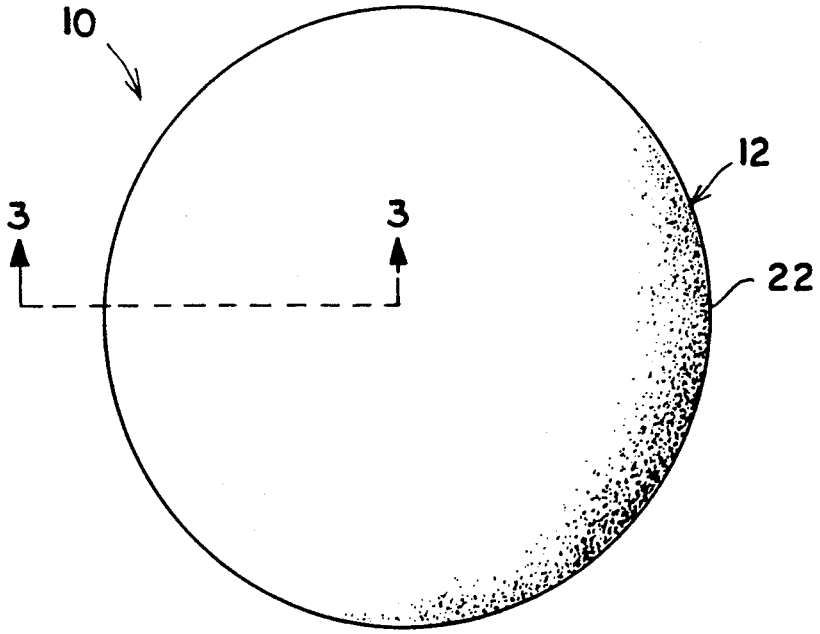
FIG. 2 is a top view of the Oil Well Fire Extinguisher.

Referring to FIGS. 1–4*b* an embodiment of the invention is shown in which the Oil Well Fire Extinguisher 10 is a spherical, rigid apparatus. The invention 10 is a device comprised of a main body 12, a flange assembly 14, a throttle assembly 16, a collection chamber 18, and a main or throttle chamber 19.

Main body 12 is a rigid structure with a base 20 and a spherical wall 22. Base 20 includes a base opening 24 which is placed over a fire source. Base opening 24 leads into throttle chamber 19. The shape of main body 12 allows for the containment of the immediate area of earth surface and air surrounding a fire source by sealing the environment and contolling the expelled energies of the oil well fire. The underlying flange assembly 14 rests against the surface or earth surrounding a fire source and denies the inspiration of air into device 10, while containing the expelled energies within device 10.

Figure 3:
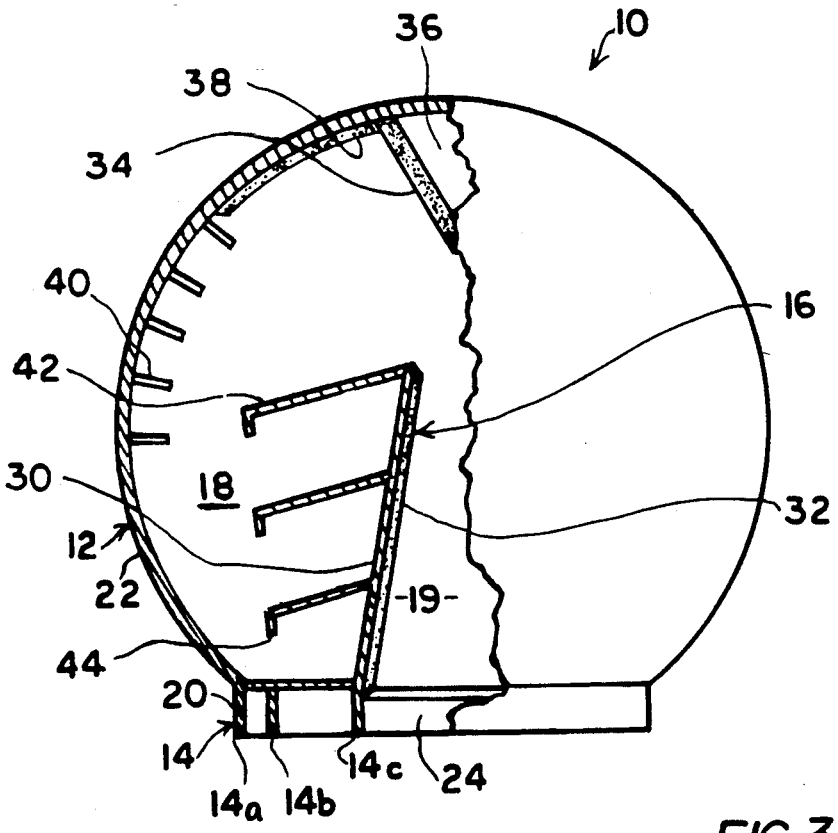
FIG. 3 is a sectional view, along Section 3—3, FIG. 2, of the Oil Well Fire Extinguisher.
Figure 4A:
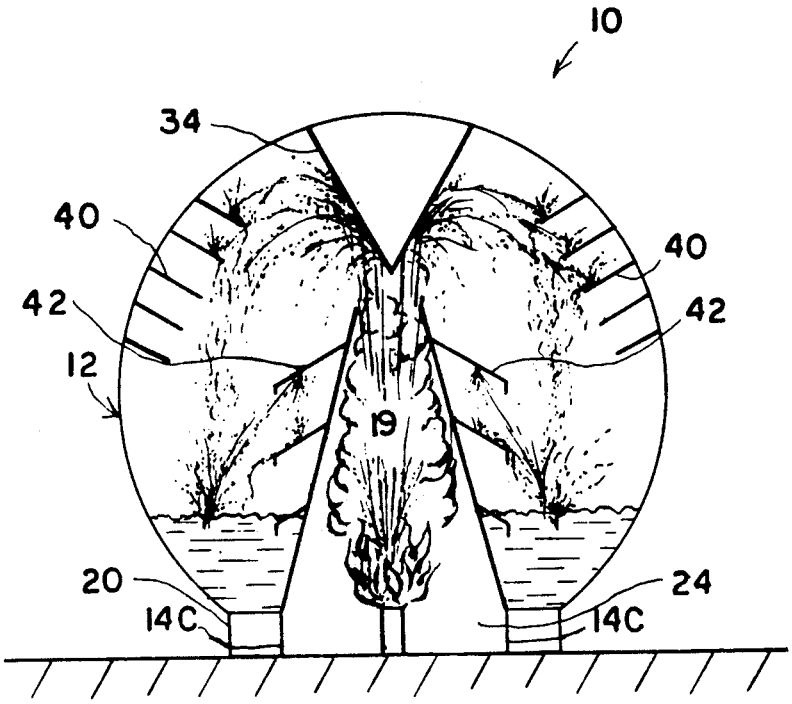
FIG. 4*a* and FIG. 4*b* are sequence illustrations in schematic of the oil well fire extinguisher in operation.
Figure 4B:
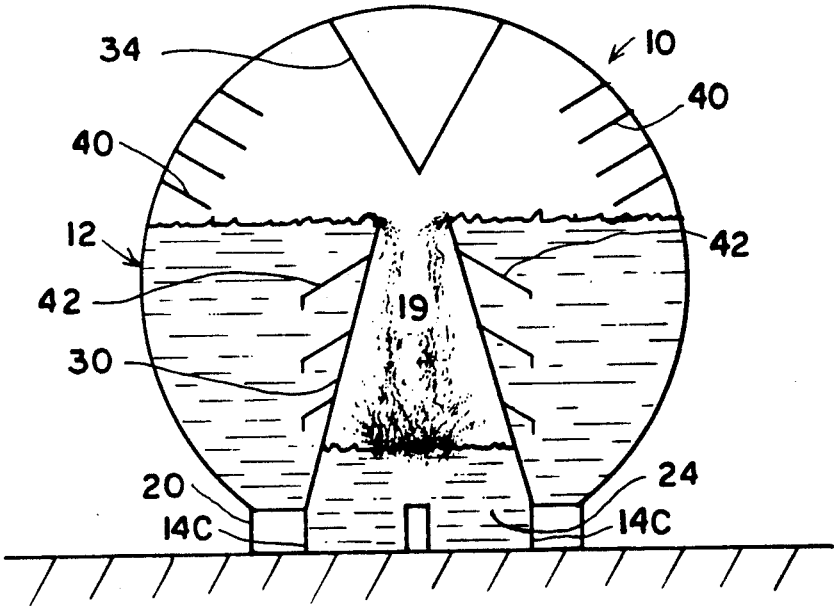

Throttle assembly 16, shown in FIG. 3, performs the function of directing the expelled energies of the fire in a designed and controlled manner through throttle chamber 19 and into collection chamber 18.

The collection chamber 18, also shown in FIG. 3, allows for accumulation of unburnt oil in a specific and desired location of the invention 10.

Referring to FIG. 3, an embodiment of the invention 10 is displayed in sectional view for thorough understanding. Flange assembly 14 encircles base 20 and includes an external flange 14*a*, a medial flange 14*b*, and an internal flange 14*c*, as shown in FIG. 3. Flange assembly 14 supports main body 12 in an upright position and rests against the surface surrounding a fire source. External flange 14*a* seals the surface or earth adjacent the fire and prevents inspired air from entering base opening 24. Medial flange 14*b* is encompassed by external flange 14*a* and serves the function of a stop-gap measure preventing inspired air from entering the base opening 24 and preventing the flow of energy out of device 10. Internal flange 14*c* encircles base opening 24 and prevents expiration of expelled energies of the oil well, while directing the combustion and energy in an upward direction through base opening 24 and into throttle chamber 19. Overall, the series of flanges 14*a–c* restrict the flow of air and energy within device 10 in order to eliminate inspired air and allow containment of expired energies.

As shown in FIG. 3, the throttle assembly 16 includes internal flange 14*c* and throttle chute 30 which is integral with internal flange 14*c* and extends upward into main body 12 at an acute angle. Internal flange 14*c* and throttle chute 30 encircle fire chamber 19. A ceramic insulator 32 is attached to the inner surface of throttle chute 30 to protect throttle chute 30 and directs the fire into the throttle chamber 19.

The throttle assembly 16, shown in FIG. 3, accelerates expelled energies of a fire through a vertically decreasing area. The angle of throttle assembly 16 is 18°, in the preferred embodiment, and permits the foundation of a high pressure area within throttle chamber 19 which is encompassed by throttle assembly 16. This high pressure formation causes the fire to burn at an increased rate. The increased burning rate requiring an increase of ambient air in the throttle chamber 19, but ambient air available is diminished by the underlying flange assembly 14. Connected at the top of wall 12 is a ceramic cap deflector 34 which redirects the expelled energies of the fire from throttle chamber 19 outward and downward into the oil collection chamber 18. Ceramic cap deflector 34 extends downwardly at an acute angle from the top of wall 12 and encircles an expansion chamber 36. In the preferred embodiment, the creamic cap deflector's walls form an 18° angle vertical line. The expansion chamber 36 permits expansion due to the heat generated by the fire consumption of the expelled energies. Ceramic apex insulator 38 located along the inner surface of wall 12, as shown in FIG. 3, allows for the direction of the expelled energies in a controlled and designed manner, while insuring minimal damage to the main body 12.

Expelled energy and oil of the fire deflected by ceramic cap deflector 34 and apex insulator 38 is channeled by velocity diffusion bars 40, shown in FIG. 3. Diffusion bars 40 are one inch diameter steel bars which diffuse and absorb expelled energies of the oil well fire allowing the unburnt oil to accumulate in the collection chamber 18. The reservoir of unburnt oil ascends upward of the device in a controlled manner due to the placement of velocity diffusion plates 42. These plates 42 encircle the throttle chute 16 and restrict backwash of oil directly into the collection chamber. The adaptation of an affixed lip 44 at 90° to the diffusion plate 42 helps prevent the backwash of oil collecting in the collection chamber 18.

Accumulated unburnt oil collects in collection chamber 18 and displaces into the throttle chamber 18, replacing the consumed chamber ambient air. This designed action presents space and volume constrictions to the oil well fire, thus extinguishing the flame by suffocation and drowning. The damming effect of the internal flange assembly 14 permits pooling of unburnt oil until an eventual overflow within the main body or throttle chamber is affected.

Although one detailed embodiment of the invention is illustrated in the drawings and previously described in detail, this invention contemplates any configuration and design of components which will accomplish the equivalent result. This invention could be designed with a pyramid or box shape and provide an identical fire extinguishing result.

I claim:

1. An apparatus for extinguishing an oil well fire comprising:

a) a dome-like containment structure comprising a base and an outer wall structure defining an enclosed area within said wall structure;

b) an opening in said base leading into said enclosed area;

c) throttle assembly extending upwardly from said opening into said enclosed area so as to define a throttle chamber within the throttle assembly and an oil collection chamber surrounding said throttle assembly, wherein unburnt oil from said oil fire is directed upwardly through said throttle assembly;

d) means disposed above said throttle assembly for deflecting the unburnt oil from said oil fire into the oil collection chamber, whereby the oil accumulates in said collection chamber and overflows into the throttle chamber to help extinguish the oil well fire; and e) diffusion plates extending generally outward from said throttle assembly for preventing backwash as the unburnt oil accumulates in the collection chamber.

2. The apparatus of claim 1 wherein the throttle assembly is tapered as thr throttle assembly extends into the enclosed area.

3. The apparatus of claim 1 wherein the means disposed above said throttle assembly for deflecting the unburnt oil is a cone-shaped deflector.

4. The apparatus of claim 1 wherein each diffusion plate includes an end having a lip extending therefrom for controlling the unburnt oil in the collection accumulating chamber.

5. The apparatus of claim 1 wherein the wall structure includes a plurality of diffusion bars extending from a surface of the wall structure into the wall structure's encompassed chamber for diffusing the oil passing from the throttle area into the collection chamber.

6. The apparatus of claim 1 wherein said base includes at least one flange surrounding the base opening.

7. A method for extinguishing an oil well fire comprising:

a) lowering a containment structure over said oil well fire, wherein said containment structure includes an outer wall structure, an inner wall structure, a throttle chamber within said inner structure, and an oil collection chamber surrounding said inner wall structure;

b) directing the oil well fire upwardly through the throttle chamber;

c) deflecting the oil well fire into the oil collection chamber; and d) accumulating unburnt oil in said oil collection chamber, wherein the accumulated oil rises in the collection chamber and overflows into said throttle chamber to help drown said oil well fire.

8. The method of claim 7 further including the step of diffusing the umburnt oil from said oil well fire by directing the fire against one or more diffusion bars formed on an inside surface of said containment structure.

9. The method of claim 7 further including the step of baffling the accumulated oil within the oil collection chamber to prevent backwash of the unburnt oil.

* * * * *